US007794285B1

(12) United States Patent
Huang

(10) Patent No.: US 7,794,285 B1
(45) Date of Patent: Sep. 14, 2010

(54) AUDIO JACK CONNECTOR

(75) Inventor: Sheng-Yuan Huang, Tu-Cheng (TW)

(73) Assignee: Cheng Uei Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/630,839

(22) Filed: Dec. 3, 2009

(51) Int. Cl.
*H01R 24/04* (2006.01)

(52) U.S. Cl. ..... 439/668

(58) Field of Classification Search ..... 439/668, 439/660, 669, 638
See application file for complete search history.

(56) References Cited

U.S. PATENT DOCUMENTS 7,591,685 B2 * 9/2009 Zhu et al. ..... 439/668
7,618,294 B1 * 11/2009 Lin et al. ..... 439/669
7,637,787 B2 * 12/2009 Chien et al. ..... 439/668
7,648,400 B2 * 1/2010 Zhu et al. ..... 439/668
7,654,872 B2 * 2/2010 Lin et al. ..... 439/668

* cited by examiner

*Primary Examiner*—Khiem Nguyen
(74) *Attorney, Agent, or Firm*—Cheng-Ju Jiang

(57) ABSTRACT

An audio jack connector for receiving an audio plug connector includes an insulating housing and a contact terminal. The insulating housing defines an insertion hole from a front end to a rear end thereof for receiving the audio plug connector and a recess communicating with the insertion hole. The contact terminal has a connecting portion received in the recess. Two opposite ends of the connecting portion are extended towards a same side to form a base portion and a first elastic arm. A first contact portion is protruded towards the base portion from a free end of the first elastic arm. A second elastic arm is bent towards the connecting portion from one end of the base portion. A second contact portion is protruded towards the first elastic arm from a free end of the second elastic arm. The first and second contact portions protrude into the insertion hole.

7 Claims, 4 Drawing Sheets

AUDIO JACK CONNECTOR

BACKGROUND OF THE INVENTION

1. Field of the Invention

The present invention generally relates to a connector, and more particularly to an audio jack connector.

2. The Related Art

An earphone having an audio plug connector connects with an electronic device by an audio jack connector of the electronic device. With the audio jack connector connected with the audio plug connector, a user can listen to the audio signals delivered by the electronic device.

Referring to FIG. 6, a conventional audio jack connector 4 for mating with an audio plug connector 5 includes an insulating housing 41 and a plurality of terminals disposed in the insulating housing 41. The terminals include a plurality of spring terminals 421 and a contact terminal 422 disposed in the insulating housing 41 for contacting the audio plug connector 5, respectively. The insulating housing 41 defines an insertion hole 411 from a front end to a rear end thereof to receive the audio plug connector 5. The contact terminal 422 has a base portion 4221 disposed in a rear end of the insertion hole 411 of the insulating housing 41, a soldering portion 4222 exposed out of the insertion hole 411 to be soldered with a printed circuit board (not shown) and a contact portion 4223 stretching into the insertion hole 411 for contacting with the audio plug connector 5 at a side of the audio plug connector 5. However, when the audio plug connector 5 is inserted with force in a direction oblique to the axis of the insertion hole 411, the audio plug connector 5 is apt to tilt to a side of the insertion hole 411 so that make an electrical connection between the audio jack connector 4 and the corresponding audio plug connector 5 unstable.

SUMMARY OF THE INVENTION

An object of the invention is to provide an audio jack connector for receiving an audio plug connector with a tip end. The audio jack connector includes an insulating housing and a contact terminal. The insulating housing defines an insertion hole from a front end to a rear end thereof for receiving the audio plug connector and a recess communicating with the insertion hole at a rear end thereof. The contact terminal is received in the recess. The contact terminal has a connecting portion received in a rear of the recess and located in rear of the tip end of the audio plug connector when the audio plug connector is inserted in the insertion hole. Two opposite ends of the connecting portion are extended towards a same side to form a base portion and a first elastic arm facing the base portion, respectively. A first contact portion is protruded towards the base portion from a free end of the first elastic arm. A second elastic arm is bent and extended towards the connecting portion from one end of the base portion opposite to the connecting portion. A second contact portion is protruded towards the first elastic arm from a free end of the second elastic arm. Wherein, the first and second contact portions protrude into the insertion hole for abutting against two opposed sides of the tip end of the audio jack connector.

As described above, the audio jack connector utilizes the contact terminal for making the audio plug connector disposed in the insertion hole of the insulating housing of the audio jack connector firmly by means of the first contact portion and the second contact portion abutting against two opposed sides of the tip end of the audio jack connector so as to form a steady electrical connection between the audio jack connector and the corresponding audio plug connector.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
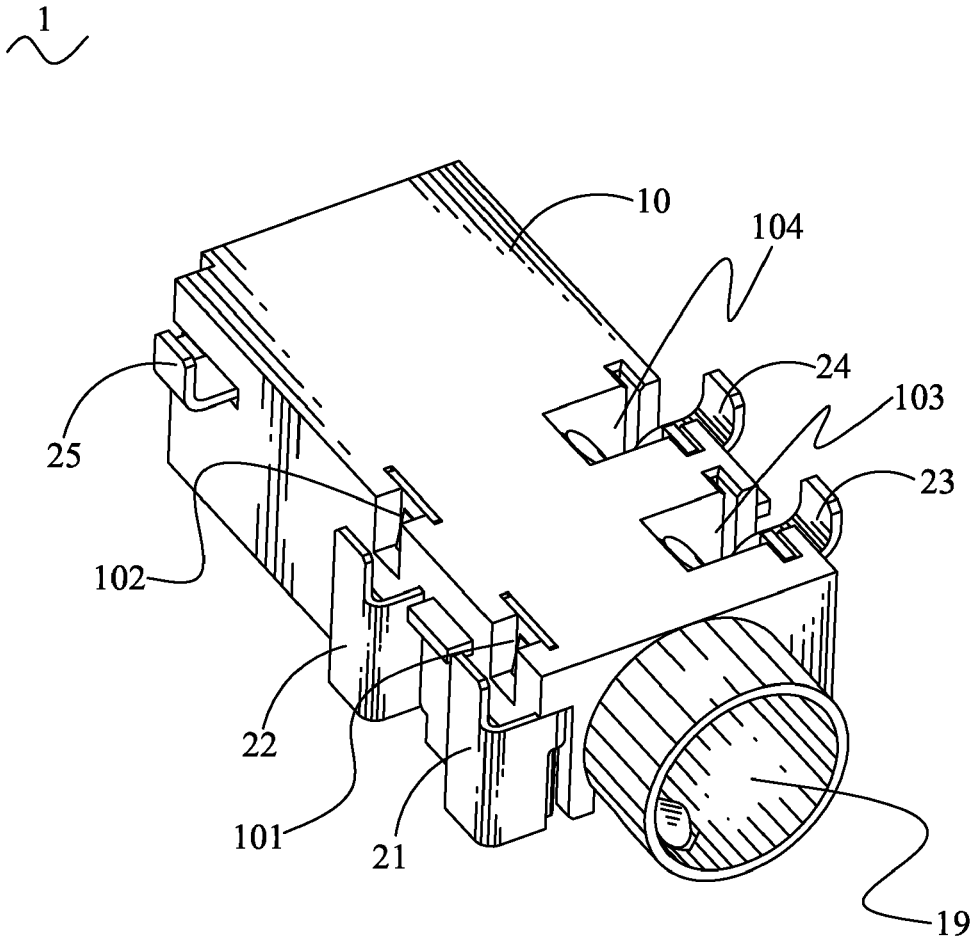
FIG. 1 is a perspective view of an audio jack connector in accordance with the present invention.
Figure 2:
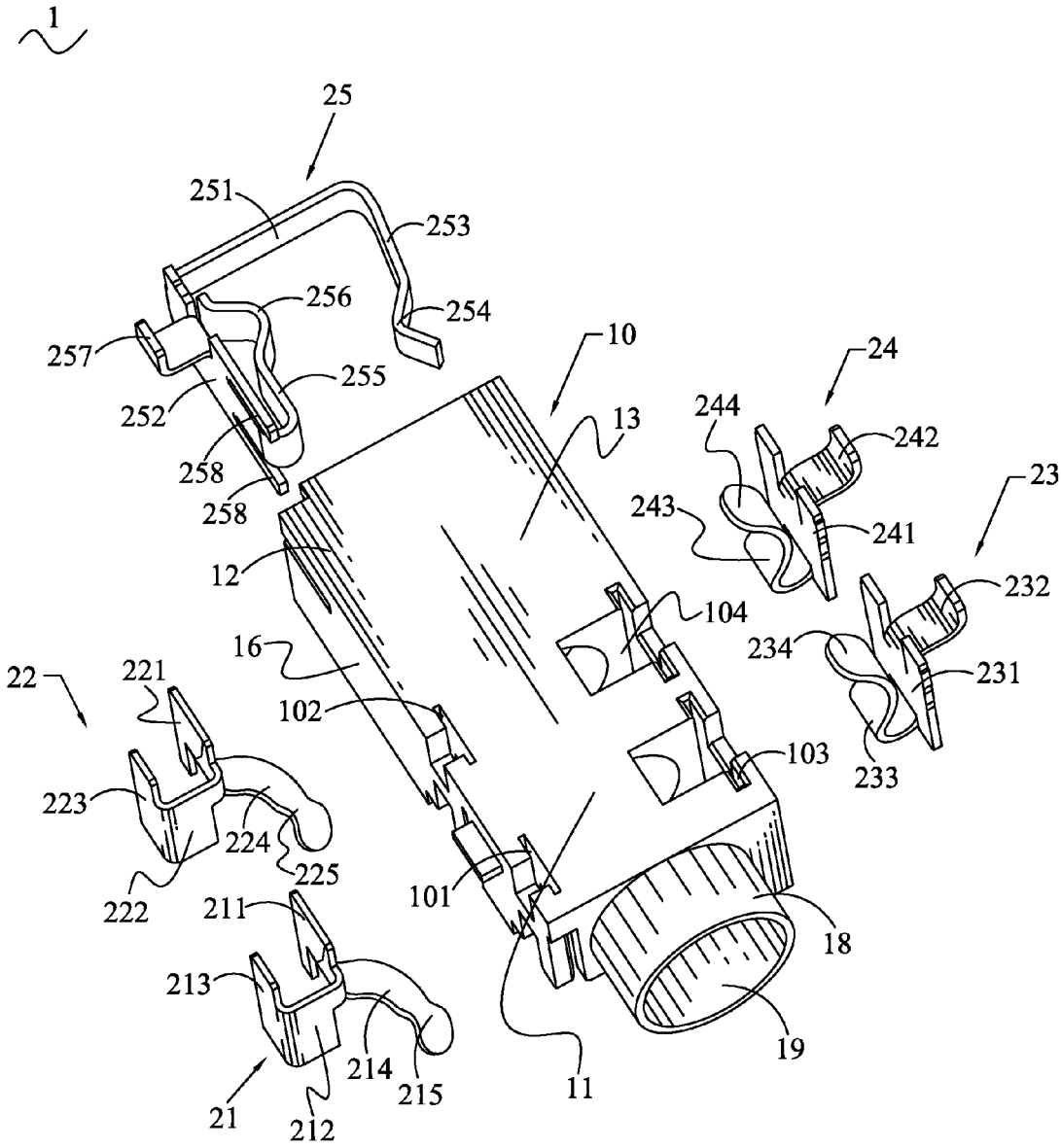
FIG. 2 is an exploded view of the audio jack connector of FIG. 1.
Figure 3:
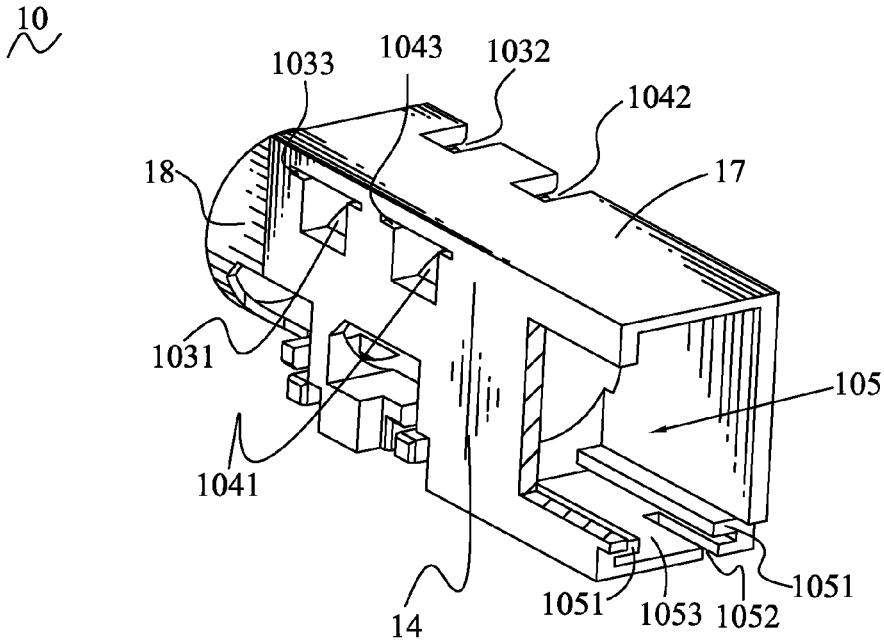
FIG. 3 is a partial sectional view of an insulating housing of the audio jack connector of FIG. 1.
Figure 4:
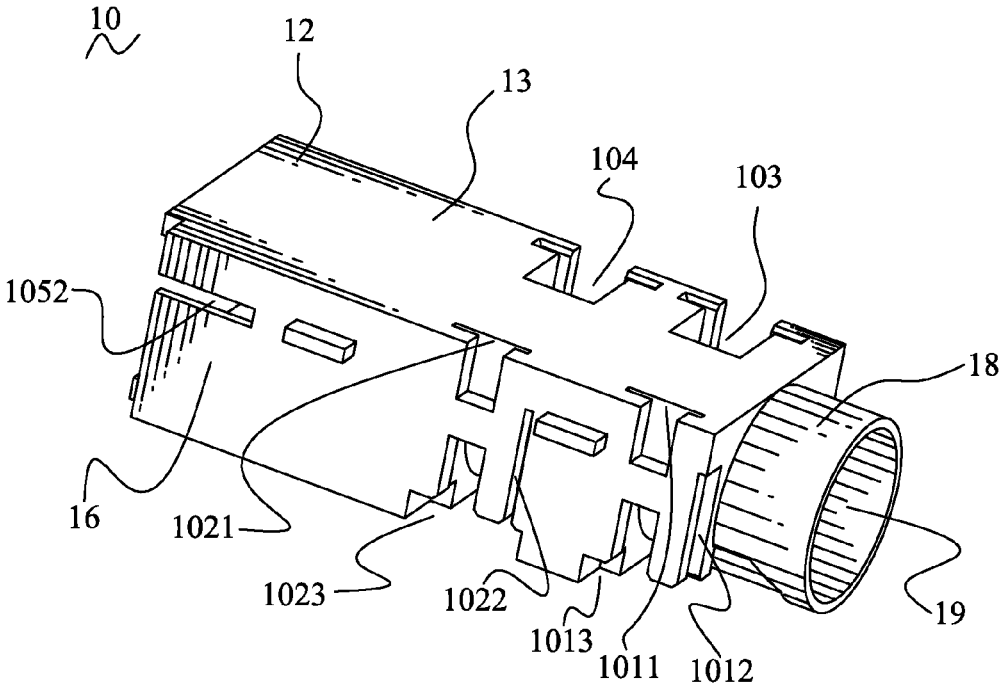
FIG. 4 is a perspective view of the insulating housing of the audio jack connector of FIG. 1.
Figure 5:
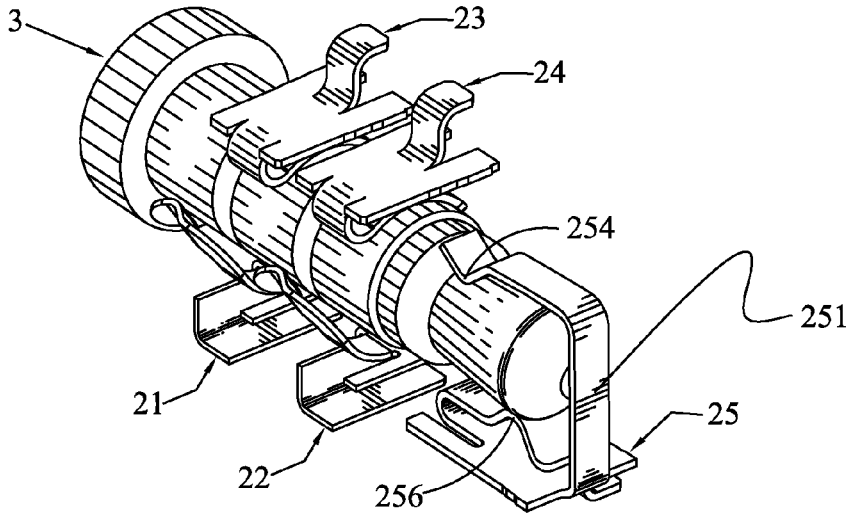
FIG. 5 is a perspective view of a plurality of terminals of the audio jack connector of FIG. 1, showing the terminals contacting with an audio plug connector.
Figure 6:
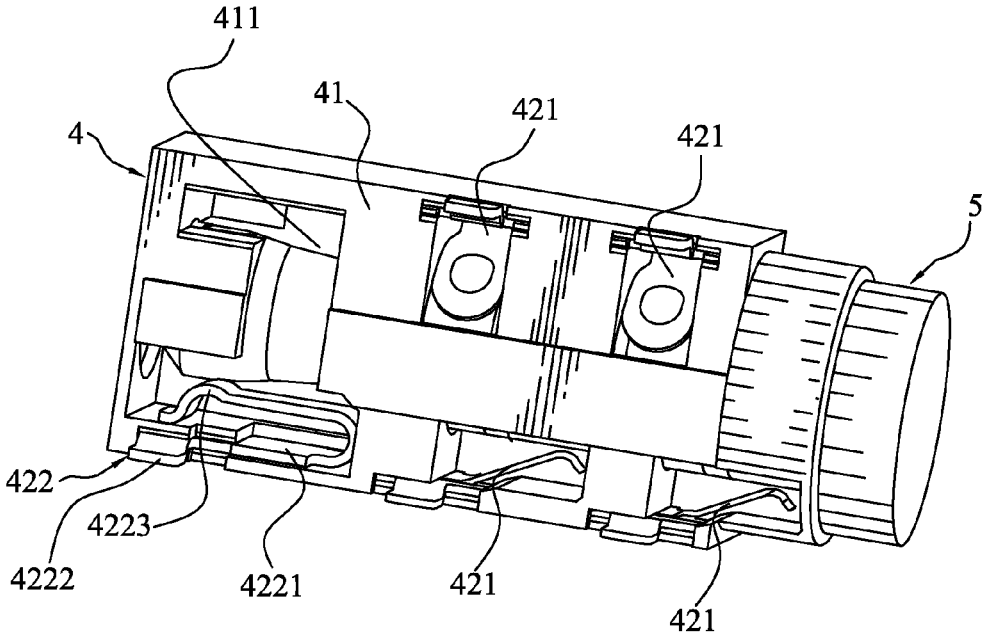
FIG. 6 (Prior Art)
FIG. 6 is a perspective view of an audio jack connector according to a prior art, in which an audio plug connector is inserted.

Referring to FIGS. 1-2 and FIG. 5, an audio jack connector 1 according to the present invention is shown. The audio jack connector 1 includes an insulating housing 10 and a plurality of terminals disposed in the insulating housing 10. Herein, supposing an audio plug connector 3 with a tip end is inserted into the audio jack connector 1 along a front and rear inserting direction, for clear description.

Referring to FIGS. 1-5, the insulating housing 10 is of a substantially rectangular shape and defines a front end 11, a rear end 12 opposite to the front end 11, a top surface 13, a bottom surface 14 opposite to the top surface 13, a first lateral surface 16 and a second lateral surface 17 opposite to the first lateral surface 16. The front end 11 has a substantial middle portion protruded outwards to form a circular platform 18. An insertion hole 19, with a circular cross-section, is formed in the insulating housing 10 and passes through middle portions of the platform 18 and the rear end 12 of the insulating housing 10 for receiving the mating audio plug connector 3 from a front portion thereof. The insulating housing 10 defines a first groove 101, a second groove 102, a third groove 103, a fourth groove 104 and a recess 105.

The first groove 101 has a first fixing groove 1011 located at a front portion of the top surface 13 adjacent to the first lateral surface 16 and extending vertically to pass through the bottom surface 14, and communicating with the insertion hole 19. The first lateral surface 16 defines a first holding groove 1012 located in front of the first fixing groove 1011, extending vertically to pass through the bottom surface 14 and communicating with the first fixing groove 1011. A rectangular first receiving gap 1013 is located at a front portion of the bottom surface 14 extending longitudinally to communicate with the first fixing groove 1011, the first holding groove 1012 and the insertion hole 19 and pass through the first lateral surface 16. The second groove 102 is of the same structure as the first groove 101 and located in rear of the first groove 101. The second groove 102 and the first groove 101 are aligned with each other along a longitudinal direction. The second groove 102 has a second fixing groove 1021, a second holding groove 1022 and a second receiving gap 1023. The third groove 103 has a rectangular third holding groove 1031 located at a front portion of the top surface 13 adjacent to the second lateral surface 17 and extending vertically to pass through the bottom surface 14 and communicate with the insertion hole 19. A rectangular third receiving gap 1032 is formed at a front portion of the second lateral surface 17 to pass through the top surface 13. The top surface 13 defines a third fixing groove 1033 between the third receiving gap 1032 and the third holding groove 1031 and communicating with the third receiving gap 1032 and the third holding groove 1031. The third fixing groove 1033 extends longitudinally and vertically to pass through the bottom surface 14 and communicate with the insertion hole 19. The fourth groove 104 is of the same structure as the third groove 103 and located in rear of the third groove 103. The third groove 103 and the fourth groove 104 are aligned with each other along a longitudinally direction. The fourth groove 104 has a fourth holding groove 1041, a fourth receiving gap 1042 and a fourth fixing groove 1043.

The recess 105 communicates with the insertion hole 19 at a rear end thereof. Portions of a top surface and a bottom surface of the recess 105 adjacent one side surface 1053 thereof have portions protruded facing to each other to form a pair of holding portions 1051. A portion of the one side surface 1053 of the recess 105 is cut to form a slot 1052 penetrating through the first lateral surface 16 and the rear end 12 of the insulating housing 10.

Referring to FIGS. 1-5, the terminals received in the insulating housing 10 are divided into a first terminal group, a second terminal group and a contact terminal 25. The first terminal group includes a first terminal 21 and a second terminal 22, which are received in the first groove 101 and the second groove 102, respectively. The first terminal 21 has a rectangular first fixing board 211 disposed vertically and fixed in the first fixing groove 1011 of the first groove 101. A front end of the first fixing board 211 is bent perpendicularly to form a first base plate 212 received in the first holding groove 1012 and a free end of the first base plate 212 is bent perpendicularly to form a first soldering portion 213 facing the first fixing board 211. The first fixing board 211, the first base plate 212 and the first soldering portion 213 cooperate to show a substantial lying-U shape. A front of a bottom edge of the first fixing board 211 is bent towards an opposite direction to the first base plate 212 and then bent towards an opposite direction to the first soldering portion 213 to form a first elastic portion 214. A first contact rib 215 is formed by a free end of the first elastic portion 214 being arched into the insertion hole 19. The first soldering portion 213 is exposed outside the first lateral surface 16 from the first receiving gap 1013 to be soldered with a printed circuit board (not shown). The first elastic portion 214 stretches into the insertion hole 19 for making the first contact rib 215 on the first elastic portion 214 contact with the mating audio plug connector 3. The second terminal 22 is of the same structure as the first terminal 21. The second terminal 22 has a second fixing board 221 received in the second fixing groove 1021, a second base plate 222 received in the second holding groove 1022, a second soldering portion 223 exposed outside the first lateral surface 16 from the second receiving gap 1023 to be soldered with the printed circuit board, a second elastic portion 224 stretching into the insertion hole 19 so as to make a second contact rib 225 on the second elastic portion 224 contact with the mating audio plug connector 3.

The second terminal group includes a third terminal 23 and a fourth terminal 24, which are received in the third groove 103 and the fourth groove 104, respectively. The third terminal 23 has a rectangular third fixing board 231 disposed vertically and fixed in the third fixing groove 1033 of the third groove 103. A top edge of the edge of the third fixing board 231 is bent perpendicularly to form a third soldering portion 232 exposed outside the second lateral surface 17 from the third receiving gap 1032 for being soldered with the printed circuit board. A bottom edge of the third fixing board 231 is bent towards an opposite direction to the third soldering portion 232 and then extends back to the third fixing board 231 to form a third elastic portion 233 received in the third holding groove 1031. A third contact rib 234 is formed by a free end of the third elastic portion 233 being arched into the insertion hole 19. The third contact rib 234 stretches into the insertion hole 19 for contacting with the mating audio plug connector 3. The fourth terminal 24 is of the same structure as the third terminal 23. The fourth terminal 24 has a fourth fixing board 241 received in the fourth fixing groove 1043, a fourth soldering portion 242 exposed outside the second lateral surface 17 from the fourth receiving gap 1042 for being soldered with the printed circuit board and a fourth elastic portion 243 received in the fourth holding groove 1041 with a fourth contact rib 244 on the fourth elastic portion 243 stretching into the insertion hole 19 for contacting with the mating audio plug connector 3.

The contact terminal 25 is received in the recess 105. The contact terminal 25 has a connecting portion 251 received in a rear of the recess 105 in an orientation perpendicular to the axis of the insertion hole 19 (that is, an orientation in which the walls of the connecting portion 251 are perpendicular to the axis of the insertion hole 19) and located in rear of the tip end of the audio plug connector 3 when the audio plug connector 3 is inserted in the insertion hole 19. Two opposite ends of the connecting portion 251 are extended along the axis of the insertion hole 19 to form a plate-shaped base portion 252 and a first elastic arm 253 facing the base portion 252, respectively. The base portion 252, the connecting portion 251 and the first elastic arm 253 cooperate to show a substantial inverse lying-U shape. One end of the base portion 252 opposite to the connecting portion 251 is bent and then extended towards the connecting portion 251 to form a second elastic arm 255 located between the base portion 252 and the first elastic arm 253. The connecting portion 251 and the second elastic arm 255 are respectively connected with middles of two opposed ends of the base portion 252. A first contact portion 254 is formed by a free end of the first elastic arm 253 being arched into the insertion hole 19 towards the second elastic arm 255. A second contact portion 256 is formed by a free end of the second elastic arm 255 being arched into the insertion hole 19 towards the first elastic arm 253. A top edge of the base portion is bent perpendicularly and outwardly to form a fifth soldering portion 257 adjacent to the connecting portion 251. Two sides of the end of the base portion 252 where the second elastic arm 255 is extended is cut to form a pair of locating bars 258. The base portion 252 is restricted between the side surface 1053 of the recess 105 and the holding portions 1051 with the two locating bars 258 being located under the corresponding holding portions 1051 for ensuring a firm engagement between the contact terminal 25 and the insulating housing 10. The connecting portion 251, the first elastic arm 253 and the second elastic arm 255 are located between the holding portions 1051 of the recess 105. The contact portions 254, 256 stretch into the insertion hole 19 for contacting with the tip end of the mating audio plug connector 3 in an embracing fashion. The fifth soldering portion 257 is exposed outside the first lateral surface 16 from the slot 1052 of the recess 105 for being soldered with the printed circuit board.

Referring to FIGS. 1-5, in use, when the corresponding audio plug connector 3 is completely inserted into the insertion hole 19 of the insulating housing 10 of the audio jack connector 1. The contact ribs 215, 225, 234, 244 and the contact portions 254, 256 will electrically contact with the corresponding audio plug connector 3, which makes audio signals transmit between the audio jack connector 1 and the corresponding audio plug connector 3. The first contact portion 254 is in front of the second contact portion 256 for abutting against a front and a rear of the tip end of the audio plug connector 3, respectively. At the same time, due to elastic deformation of the elastic arms 253, 255, there is a contact pressure with respect to the audio plug connector 3 so that a favorable elastic spring force can be attained. The first contact portion 254 and the second contact portion 256 of the contact terminal 25 abut against two opposed sides of the tip end of the corresponding audio plug connector 3 in an embracing fashion for preventing the audio plug connector 3 from being tilted to a side of the insertion hole 19 so as to form a steady electrical connection between the audio jack connector 1 and the corresponding audio plug connector 3.

As described above, the audio jack connector 1 utilizes the contact terminal 25 for making the audio plug connector 3 disposed in the insertion hole 19 of the insulating housing 10 of the audio jack connector 1 firmly by means of the first contact portion 254 and the second contact portion 256 abutting against two opposed sides of the tip end of the audio plug connector 3 so as to form a steady electrical connection between the audio jack connector 1 and the corresponding audio plug connector 3.

The forgoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. An audio jack connector for receiving an audio plug connector with a tip end, comprising:

an insulating housing defining an insertion hole from a front end to a rear end thereof for receiving the audio plug connector and a recess communicating with the insertion hole at a rear end thereof; and a contact terminal received in the recess, the contact terminal having a connecting portion received in a rear of the recess and located in rear of the tip end of the audio plug connector when the audio plug connector is inserted in the insertion hole, two opposite ends of the connecting portion extended towards a same side to form a base portion and a first elastic arm facing the base portion, respectively, a first contact portion being protruded towards the base portion from a free end of the first elastic arm, a second elastic arm being bent and extended towards the connecting portion from one end of the base portion opposite to the connecting portion, a second contact portion being protruded towards the first elastic arm from a free end of the second elastic arm, wherein the first and second contact portions protrude into the insertion hole for abutting against two opposed sides of the tip end of the audio plug connector.

2. The audio jack connector as claimed in claim 1, wherein the first and second contact portions are formed by the free ends of the first elastic arm and the second elastic arm being arched into the insertion hole, respectively.

3. The audio jack connector as claimed in claim 1, wherein the first contact portion is in front of the second contact portion for abutting against a front and a rear of the audio jack connector, respectively.

4. The audio jack connector as claimed in claim 1, wherein the contact terminal further has a soldering portion extended from the base portion and exposed outside the recess.

5. The audio jack connector as claimed in claim 1, wherein portions of a top surface and a bottom surface of the recess adjacent one side surface thereof have portions protruded facing to each other to form a pair of holding portions, the base portion of the contact terminal is substantially plate shape and restricted between the one side surface and the holding portions, the connecting portion and the second elastic arm are respectively connected with middles of two opposed ends of the base portion and located between the holding portions.

6. The audio jack connector as claimed in claim 5, wherein a portion of the one side surface of the recess is cut to form a slot penetrating a lateral surface and the rear end of the insulating housing, the contact terminal further includes a soldering portion extended opposite to the second elastic arm from a portion of the base portion and exposed outside the insulating housing from the slot.

7. The audio jack connector as claimed in claim 5, wherein two sides of the one end of the base portion where the second elastic arm is extended is cut to form two locating bars located under the corresponding holding portions.

* * * * *